US009987677B2

(12) United States Patent
Arnett et al.

(10) Patent No.: US 9,987,677 B2
(45) Date of Patent: Jun. 5, 2018

(54) METHOD AND ASSEMBLY FOR FORMING COMPONENTS HAVING INTERNAL PASSAGES USING A JACKETED CORE

(71) Applicant: General Electric Company, Schenectady, NY (US)

(72) Inventors: Michael Douglas Arnett, Simpsonville, SC (US); Thomas Michael Moors, Simpsonville, SC (US); Arthur Samuel Peck, Greenville, SC (US)

(73) Assignee: General Electric Company, Schenectady, NY (US)

( * ) Notice: Subject to any disclaimer, the term of this patent is extended or adjusted under 35 U.S.C. 154(b) by 257 days.

(21) Appl. No.: 14/972,413

(22) Filed: Dec. 17, 2015

(65) Prior Publication Data

US 2017/0173675 A1 Jun. 22, 2017

(51) Int. Cl.

| | |
|---|---|
| ***B22C 9/24*** | (2006.01) |
| ***B22C 9/10*** | (2006.01) |
| ***B22C 3/00*** | (2006.01) |
| ***B22D 25/02*** | (2006.01) |
| ***B22D 29/00*** | (2006.01) |

(52) U.S. Cl.

CPC ..... *B22C 9/24* (2013.01); *B22C 3/00* (2013.01); *B22C 9/10* (2013.01); *B22C 9/106* (2013.01); *B22C 9/108* (2013.01); *B22D 25/02* (2013.01); *B22D 29/002* (2013.01)

(58) Field of Classification Search

CPC .. B22C 3/00; B22C 9/10; B22C 9/106; B22C 9/108; B22C 9/24; B22D 19/0072; B22D 25/02; B22D 29/002

USPC ..... 164/24, 28, 33, 35, 91, 132, 365, 366, 164/367, 369

See application file for complete search history.

(56) References Cited

U.S. PATENT DOCUMENTS

| | | | |
|---|---|---|---|
| 2,687,278 | A | 8/1954 | Smith et al. |
| 2,756,475 | A | 7/1956 | Hanink et al. |

(Continued)

FOREIGN PATENT DOCUMENTS

| | | | |
|---|---|---|---|
| CH | 640440 | A5 | 1/1984 |
| EP | 0025481 | A1 | 3/1981 |

(Continued)

OTHER PUBLICATIONS

Ziegelheim, J. et al., "Diffusion bondability of similar/dissimilar light metal sheets," Journal of Materials Processing echnology 186.1 (May 2007): 87-93.

(Continued)

*Primary Examiner* — Kevin P Kerns

(74) *Attorney, Agent, or Firm* — Armstrong Teasdale LLP

(57) ABSTRACT

A method of forming a component having an internal passage defined therein includes positioning a jacketed core with respect to a mold. The jacketed core includes a hollow structure formed from a first material, an inner core disposed within the hollow structure, and a core channel that extends from at least a first end of the inner core through at least a portion of inner core. The method also includes introducing a component material in a molten state into a cavity of the mold, such that the component material in the molten state at least partially absorbs the first material from the jacketed core within the cavity. The method further includes cooling the component material in the cavity to form the component. The inner core defines the internal passage within the component.

20 Claims, 6 Drawing Sheets

(56) References Cited

U.S. PATENT DOCUMENTS 2,991,520 A 7/1961 Dalton
3,160,931 A 12/1964 Leach
3,222,435 A 12/1965 Mellen, Jr. et al.
3,222,737 A 12/1965 Reuter
3,475,375 A 10/1969 Yates
3,563,711 A 2/1971 Hammond et al.
3,596,703 A 8/1971 Bishop et al.
3,597,248 A 8/1971 Yates
3,662,816 A 5/1972 Bishop et al.
3,678,987 A 7/1972 Kydd
3,689,986 A 9/1972 Takahashi et al.
3,694,264 A 9/1972 Weinland et al.
3,773,506 A 11/1973 Larker et al.
3,824,113 A 7/1974 Loxley et al.
3,844,727 A 10/1974 Copley et al.
3,863,701 A 2/1975 Niimi et al.
3,866,448 A 2/1975 Dennis et al.
3,921,271 A 11/1975 Dennis et al.
3,996,048 A 12/1976 Fiedler
4,096,296 A 6/1978 Galmiche et al.
4,130,157 A 12/1978 Miller et al.
4,148,352 A 4/1979 Sensui et al.
4,236,568 A 12/1980 Larson
4,285,634 A 8/1981 Rossman et al.
4,352,390 A 10/1982 Larson
4,372,404 A 2/1983 Drake
4,375,233 A 3/1983 Rossmann et al.
4,417,381 A 11/1983 Higginbotham
4,432,798 A 2/1984 Helferich et al.
4,557,691 A 12/1985 Martin et al.
4,576,219 A 3/1986 Uram
4,583,581 A 4/1986 Ferguson et al.
4,604,780 A 8/1986 Metcalfe
4,637,449 A 1/1987 Mills et al.
4,738,587 A 4/1988 Kildea
4,859,141 A 8/1989 Maisch et al.
4,905,750 A 3/1990 Wolf
4,911,990 A 3/1990 Prewo et al.
4,964,148 A 10/1990 Klostermann et al.
4,986,333 A 1/1991 Gartland
5,052,463 A 10/1991 Lechner et al.
5,083,371 A 1/1992 Leibfried et al.
5,243,759 A 9/1993 Brown et al.
5,248,869 A 9/1993 Debell et al.
5,273,104 A 12/1993 Renaud
5,291,654 A 3/1994 Judd et al.
5,295,530 A 3/1994 O'Connor et al.
5,332,023 A 7/1994 Mills
5,350,002 A 9/1994 Orton
5,355,668 A 10/1994 Weil et al.
5,371,945 A 12/1994 Schnoor
5,387,280 A 2/1995 Kennerknecht
5,394,932 A 3/1995 Carozza et al.
5,398,746 A 3/1995 Igarashi
5,413,463 A 5/1995 Chin et al.
5,465,780 A 11/1995 Muntner et al.
5,467,528 A 11/1995 Bales et al.
5,468,285 A 11/1995 Kennerknecht
5,482,054 A 1/1996 Slater et al.
5,498,132 A 3/1996 Carozza et al.
5,505,250 A 4/1996 Jago
5,507,336 A 4/1996 Tobin
5,509,659 A 4/1996 Igarashi
5,524,695 A 6/1996 Schwartz
5,569,320 A 10/1996 Sasaki et al.
5,611,848 A 3/1997 Sasaki et al.
5,664,628 A 9/1997 Koehler et al.
5,679,270 A 10/1997 Thornton et al.
5,738,493 A 4/1998 Lee et al.
5,778,963 A 7/1998 Parille et al.
5,810,552 A 9/1998 Frasier
5,820,774 A 10/1998 Dietrich
5,909,773 A 6/1999 Koehler et al.
5,924,483 A 7/1999 Frasier
5,927,373 A 7/1999 Tobin
5,947,181 A 9/1999 Davis
5,951,256 A 9/1999 Dietrich
5,976,457 A 11/1999 Amaya et al.
6,029,736 A 2/2000 Naik et al.
6,039,763 A 3/2000 Shelokov
6,041,679 A 3/2000 Slater et al.
6,068,806 A 5/2000 Dietrich
6,186,741 B1 2/2001 Webb et al.
6,221,289 B1 4/2001 Corbett et al.
6,234,753 B1 5/2001 Lee
6,244,327 B1 6/2001 Frasier
6,251,526 B1 6/2001 Staub
6,327,943 B1 12/2001 Wrigley et al.
6,359,254 B1 3/2002 Brown
6,441,341 B1 8/2002 Steibel et al.
6,467,534 B1 10/2002 Klug et al.
6,474,348 B1 11/2002 Beggs et al.
6,505,678 B2 1/2003 Mertins
6,557,621 B1 5/2003 Dierksmeier et al.
6,578,623 B2 6/2003 Keller et al.
6,605,293 B1 8/2003 Giordano et al.
6,615,470 B2 9/2003 Corderman et al.
6,623,521 B2 9/2003 Steinke et al.
6,626,230 B1 9/2003 Woodrum et al.
6,634,858 B2 10/2003 Roeloffs et al.
6,637,500 B2 10/2003 Shah et al.
6,644,921 B2 11/2003 Bunker et al.
6,670,026 B2 12/2003 Steibel et al.
6,694,731 B2 2/2004 Kamen et al.
6,773,231 B2 8/2004 Bunker et al.
6,799,627 B2 10/2004 Ray et al.
6,800,234 B2 10/2004 Ferguson et al.
6,817,379 B2 11/2004 Perla
6,837,417 B2 1/2005 Srinivasan
6,896,036 B2 5/2005 Schneiders et al.
6,913,064 B2 7/2005 Beals et al.
6,929,054 B2 8/2005 Beals et al.
6,955,522 B2 10/2005 Cunha et al.
6,986,381 B2 1/2006 Ray et al.
7,028,747 B2 4/2006 Widrig et al.
7,036,556 B2 5/2006 Caputo et al.
7,052,710 B2 5/2006 Giordano et al.
7,073,561 B1 7/2006 Henn
7,093,645 B2 8/2006 Grunstra et al.
7,108,045 B2 9/2006 Wiedemer et al.
7,109,822 B2 9/2006 Perkins et al.
7,174,945 B2 2/2007 Beals et al.
7,185,695 B1 3/2007 Santeler
7,207,375 B2 4/2007 Turkington et al.
7,234,506 B2 6/2007 Grunstra et al.
7,237,375 B2 7/2007 Humcke et al.
7,237,595 B2 7/2007 Beck et al.
7,240,718 B2 7/2007 Schmidt et al.
7,243,700 B2 7/2007 Beals et al.
7,246,652 B2 7/2007 Fowler
7,270,170 B2 9/2007 Beals et al.
7,270,173 B2 9/2007 Wiedemer et al.
7,278,460 B2 10/2007 Grunstra et al.
7,278,463 B2 10/2007 Snyder et al.
7,306,026 B2 12/2007 Memmen
7,322,795 B2 1/2008 Luczak et al.
7,325,587 B2 2/2008 Memmen
7,334,625 B2 2/2008 Judge et al.
7,343,730 B2 3/2008 Humcke et al.
7,371,043 B2 5/2008 Keller
7,371,049 B2 5/2008 Cunha et al.
7,377,746 B2 5/2008 Brassfield et al.
7,410,342 B2 8/2008 Matheny
7,438,118 B2 10/2008 Santeler
7,448,433 B2 11/2008 Ortiz et al.
7,448,434 B2 11/2008 Turkington et al.
7,461,684 B2 12/2008 Liu et al.
7,478,994 B2 1/2009 Cunha et al.
7,517,225 B2 4/2009 Cherian
7,575,039 B2 8/2009 Beals et al.
7,588,069 B2 9/2009 Munz et al.
7,624,787 B2 12/2009 Lee et al.
7,625,172 B2 12/2009 Walz et al.
7,673,669 B2 3/2010 Snyder et al.

(56) References Cited

U.S. PATENT DOCUMENTS

| | | | |
|---|---|---|---|
| 7,686,065 | B2 | 3/2010 | Luczak |
| 7,713,029 | B1 | 5/2010 | Davies |
| 7,717,676 | B2 | 5/2010 | Cunha et al. |
| 7,722,327 | B1 | 5/2010 | Liang |
| 7,802,613 | B2 | 5/2010 | Bullied et al. |
| 7,727,495 | B2 | 6/2010 | Burd et al. |
| 7,731,481 | B2 | 6/2010 | Cunha et al. |
| 7,753,104 | B2 | 7/2010 | Luczak et al. |
| 7,757,745 | B2 | 7/2010 | Luczak |
| 7,771,210 | B2 | 8/2010 | Cherian |
| 7,779,892 | B2 | 8/2010 | Luczak et al. |
| 7,789,626 | B1 | 9/2010 | Liang |
| 7,798,201 | B2 | 9/2010 | Bewlay et al. |
| 7,806,681 | B2 | 10/2010 | Feick et al. |
| 7,861,766 | B2 | 1/2011 | Bochiechio et al. |
| 7,882,884 | B2 | 2/2011 | Beals et al. |
| 7,938,168 | B2 | 5/2011 | Lee et al. |
| 7,947,233 | B2 | 5/2011 | Burd et al. |
| 7,963,085 | B2 | 6/2011 | Sypeck et al. |
| 7,993,106 | B2 | 8/2011 | Walters |
| 8,057,183 | B1 | 11/2011 | Liang |
| 8,066,483 | B1 | 11/2011 | Liang |
| 8,100,165 | B2 | 1/2012 | Piggush et al. |
| 8,113,780 | B2 | 2/2012 | Cherolis |
| 8,122,583 | B2 | 2/2012 | Luczak et al. |
| 8,137,068 | B2 | 3/2012 | Surace et al. |
| 8,162,609 | B1 | 4/2012 | Liang |
| 8,167,537 | B1 | 5/2012 | Plank et al. |
| 8,171,978 | B2 | 5/2012 | Propheter-Hinckley et al. |
| 8,181,692 | B2 | 5/2012 | Frasier et al. |
| 8,196,640 | B1 | 6/2012 | Paulus et al. |
| 8,251,123 | B2 | 8/2012 | Farris et al. |
| 8,251,660 | B1 | 8/2012 | Liang |
| 8,261,810 | B1 | 9/2012 | Liang |
| 8,291,963 | B1 | 10/2012 | Trinks et al. |
| 8,297,455 | B2 | 10/2012 | Smyth |
| 8,302,668 | B1 | 11/2012 | Bullied et al. |
| 8,303,253 | B1 | 11/2012 | Liang |
| 8,307,654 | B1 | 11/2012 | Liang |
| 8,317,475 | B1 | 11/2012 | Downs |
| 8,322,988 | B1 | 12/2012 | Downs et al. |
| 8,336,606 | B2 | 12/2012 | Piggush |
| 8,342,802 | B1 | 1/2013 | Liang |
| 8,366,394 | B1 | 2/2013 | Liang |
| 8,381,923 | B2 | 2/2013 | Smyth |
| 8,414,263 | B1 | 4/2013 | Liang |
| 8,500,401 | B1 | 8/2013 | Liang |
| 8,506,256 | B1 | 8/2013 | Brostmeyer et al. |
| 8,535,004 | B2 | 9/2013 | Campbell |
| 8,622,113 | B1 | 1/2014 | Rau, III |
| 8,678,766 | B1 | 3/2014 | Liang |
| 8,734,108 | B1 | 5/2014 | Liang |
| 8,753,083 | B2 | 6/2014 | Lacy et al. |
| 8,770,931 | B2 | 7/2014 | Alvanos et al. |
| 8,777,571 | B1 | 7/2014 | Liang |
| 8,793,871 | B2 | 8/2014 | Morrison et al. |
| 8,794,298 | B2 | 8/2014 | Schlienger et al. |
| 8,807,943 | B1 | 8/2014 | Liang |
| 8,813,812 | B2 | 8/2014 | Ellgass et al. |
| 8,813,824 | B2 | 8/2014 | Appleby et al. |
| 8,858,176 | B1 | 10/2014 | Liang |
| 8,864,469 | B1 | 10/2014 | Liang |
| 8,870,524 | B1 | 10/2014 | Liang |
| 8,876,475 | B1 | 11/2014 | Liang |
| 8,893,767 | B2 | 11/2014 | Mueller et al. |
| 8,899,303 | B2 | 12/2014 | Mueller et al. |
| 8,906,170 | B2 | 12/2014 | Gigliotti, Jr. et al. |
| 8,911,208 | B2 | 12/2014 | Propheter-Hinckley et al. |
| 8,915,289 | B2 | 12/2014 | Mueller et al. |
| 8,936,068 | B2 | 1/2015 | Lee et al. |
| 8,940,114 | B2 | 1/2015 | James et al. |
| 8,969,760 | B2 | 3/2015 | Hu et al. |
| 8,978,385 | B2 | 3/2015 | Cunha |
| 8,993,923 | B2 | 3/2015 | Hu et al. |
| 8,997,836 | B2 | 4/2015 | Mueller et al. |
| 9,038,706 | B2 | 5/2015 | Hillier |
| 9,051,838 | B2 | 6/2015 | Wardle et al. |
| 9,057,277 | B2 | 6/2015 | Appleby et al. |
| 9,057,523 | B2 | 6/2015 | Cunha et al. |
| 9,061,350 | B2 | 6/2015 | Bewlay et al. |
| 9,079,241 | B2 | 7/2015 | Barber et al. |
| 9,079,803 | B2 | 7/2015 | Xu |
| 9,174,271 | B2 | 11/2015 | Newton et al. |
| 2001/0044651 | A1 | 11/2001 | Steinke et al. |
| 2002/0029567 | A1 | 3/2002 | Kamen et al. |
| 2002/0182056 | A1 | 12/2002 | Widrig et al. |
| 2002/0187065 | A1 | 12/2002 | Amaya et al. |
| 2002/0190039 | A1 | 12/2002 | Steibel et al. |
| 2002/0197161 | A1 | 12/2002 | Roeloffs et al. |
| 2003/0047197 | A1 | 3/2003 | Beggs et al. |
| 2003/0062088 | A1 | 4/2003 | Perla |
| 2003/0133799 | A1 | 7/2003 | Widrig et al. |
| 2003/0150092 | A1 | 8/2003 | Corderman et al. |
| 2003/0199969 | A1 | 10/2003 | Steinke et al. |
| 2003/0201087 | A1 | 10/2003 | Devine et al. |
| 2004/0024470 | A1 | 2/2004 | Giordano et al. |
| 2004/0055725 | A1 | 3/2004 | Ray et al. |
| 2004/0056079 | A1 | 3/2004 | Srinivasan |
| 2004/0144089 | A1 | 7/2004 | Kamen et al. |
| 2004/0154252 | A1 | 8/2004 | Sypeck et al. |
| 2004/0159985 | A1 | 8/2004 | Altoonian et al. |
| 2005/0006047 | A1 | 1/2005 | Wang et al. |
| 2005/0016706 | A1 | 1/2005 | Ray et al. |
| 2005/0087319 | A1 | 4/2005 | Beals et al. |
| 2005/0133193 | A1 | 6/2005 | Beals et al. |
| 2005/0247429 | A1 | 11/2005 | Turkington et al. |
| 2006/0032604 | A1 | 2/2006 | Beck et al. |
| 2006/0048553 | A1 | 3/2006 | Almquist |
| 2006/0065383 | A1 | 3/2006 | Ortiz et al. |
| 2006/0107668 | A1 | 5/2006 | Cunha et al. |
| 2006/0118262 | A1 | 6/2006 | Beals et al. |
| 2006/0118990 | A1 | 6/2006 | Dierkes et al. |
| 2006/0237163 | A1 | 10/2006 | Turkington et al. |
| 2006/0283168 | A1 | 12/2006 | Humcke et al. |
| 2007/0044936 | A1 | 3/2007 | Memmen |
| 2007/0059171 | A1 | 3/2007 | Simms et al. |
| 2007/0107412 | A1 | 5/2007 | Humcke et al. |
| 2007/0114001 | A1 | 5/2007 | Snyder et al. |
| 2007/0116972 | A1 | 5/2007 | Persky |
| 2007/0169605 | A1 | 7/2007 | Szymanski |
| 2007/0177975 | A1 | 8/2007 | Luczak et al. |
| 2007/0253816 | A1 | 11/2007 | Walz et al. |
| 2008/0003849 | A1 | 1/2008 | Cherian |
| 2008/0080979 | A1 | 4/2008 | Brassfield et al. |
| 2008/0131285 | A1 | 6/2008 | Albert et al. |
| 2008/0135718 | A1 | 6/2008 | Lee et al. |
| 2008/0138208 | A1 | 6/2008 | Walters |
| 2008/0138209 | A1 | 6/2008 | Cunha et al. |
| 2008/0145235 | A1 | 6/2008 | Cunha et al. |
| 2008/0169412 | A1 | 7/2008 | Snyder et al. |
| 2008/0190582 | A1 | 8/2008 | Lee et al. |
| 2009/0041587 | A1 | 2/2009 | Konter et al. |
| 2009/0095435 | A1 | 4/2009 | Luczak et al. |
| 2009/0181560 | A1 | 7/2009 | Cherian |
| 2009/0255742 | A1 | 10/2009 | Hansen |
| 2010/0021643 | A1 | 1/2010 | Lane et al. |
| 2010/0150733 | A1 | 6/2010 | Abdel-Messeh et al. |
| 2010/0200189 | A1 | 8/2010 | Qi et al. |
| 2010/0219325 | A1 | 9/2010 | Bullied et al. |
| 2010/0276103 | A1 | 11/2010 | Bullied et al. |
| 2010/0304064 | A1 | 12/2010 | Huttner |
| 2011/0048665 | A1 | 3/2011 | Schlienger et al. |
| 2011/0068077 | A1 | 3/2011 | Smyth |
| 2011/0132563 | A1 | 6/2011 | Merrill et al. |
| 2011/0132564 | A1 | 6/2011 | Merrill et al. |
| 2011/0135446 | A1 | 6/2011 | Dube |
| 2011/0146075 | A1 | 6/2011 | Hazel et al. |
| 2011/0150666 | A1 | 6/2011 | Hazel et al. |
| 2011/0189440 | A1 | 8/2011 | Appleby et al. |
| 2011/0236221 | A1 | 9/2011 | Campbell |
| 2011/0240245 | A1 | 10/2011 | Schlienger et al. |
| 2011/0250078 | A1 | 10/2011 | Bruce et al. |
| 2011/0250385 | A1 | 10/2011 | Sypeck et al. |
| 2011/0293434 | A1 | 12/2011 | Lee et al. |

(56) References Cited

U.S. PATENT DOCUMENTS

| | | | |
|---|---|---|---|
| 2011/0315337 | A1 | 12/2011 | Piggush |
| 2012/0161498 | A1 | 6/2012 | Hansen |
| 2012/0163995 | A1 | 6/2012 | Wardle et al. |
| 2012/0168108 | A1 | 7/2012 | Farris et al. |
| 2012/0183412 | A1 | 7/2012 | Lacy et al. |
| 2012/0186681 | A1 | 7/2012 | Sun et al. |
| 2012/0186768 | A1 | 7/2012 | Sun et al. |
| 2012/0193841 | A1 | 8/2012 | Wang et al. |
| 2012/0237786 | A1 | 9/2012 | Morrison et al. |
| 2012/0276361 | A1 | 11/2012 | James et al. |
| 2012/0298321 | A1 | 11/2012 | Smyth |
| 2013/0019604 | A1 | 1/2013 | Cunha et al. |
| 2013/0025287 | A1 | 1/2013 | Cunha |
| 2013/0025288 | A1 | 1/2013 | Cunha et al. |
| 2013/0064676 | A1 | 3/2013 | Salisbury et al. |
| 2013/0139990 | A1 | 6/2013 | Appleby et al. |
| 2013/0177448 | A1 | 7/2013 | Spangler |
| 2013/0220571 | A1 | 8/2013 | Mueller et al. |
| 2013/0266816 | A1 | 10/2013 | Xu |
| 2013/0280093 | A1 | 10/2013 | Zelesky et al. |
| 2013/0318771 | A1 | 12/2013 | Luczak et al. |
| 2013/0323033 | A1 | 12/2013 | Lutjen et al. |
| 2013/0327602 | A1 | 12/2013 | Barber et al. |
| 2013/0333855 | A1 | 12/2013 | Merrill et al. |
| 2013/0338267 | A1 | 12/2013 | Appleby et al. |
| 2014/0023497 | A1 | 1/2014 | Giglio et al. |
| 2014/0031458 | A1 | 1/2014 | Jansen |
| 2014/0033736 | A1 | 2/2014 | Propheter-Hinckley et al. |
| 2014/0068939 | A1 | 3/2014 | Devine, II et al. |
| 2014/0076857 | A1 | 3/2014 | Hu et al. |
| 2014/0076868 | A1 | 3/2014 | Hu et al. |
| 2014/0093387 | A1 | 4/2014 | Pointon et al. |
| 2014/0140860 | A1 | 5/2014 | Tibbott et al. |
| 2014/0169981 | A1 | 6/2014 | Bales et al. |
| 2014/0199177 | A1 | 7/2014 | Propheter-Hinckley et al. |
| 2014/0202650 | A1 | 7/2014 | Song et al. |
| 2014/0284016 | A1 | 9/2014 | Vander Wal |
| 2014/0311315 | A1 | 10/2014 | Isaac |
| 2014/0314581 | A1 | 10/2014 | McBrien et al. |
| 2014/0342175 | A1 | 11/2014 | Morrison et al. |
| 2014/0342176 | A1 | 11/2014 | Appleby et al. |
| 2014/0356560 | A1 | 12/2014 | Prete et al. |
| 2014/0363305 | A1 | 12/2014 | Shah et al. |
| 2015/0053365 | A1 | 2/2015 | Mueller et al. |
| 2015/0174653 | A1 | 6/2015 | Verner et al. |
| 2015/0184857 | A1 | 7/2015 | Cunha et al. |
| 2015/0306657 | A1 | 10/2015 | Frank |

FOREIGN PATENT DOCUMENTS

| | | | |
|---|---|---|---|
| EP | 0025481 | B1 | 2/1983 |
| EP | 0111600 | A1 | 6/1984 |
| EP | 0190114 | A1 | 8/1986 |
| EP | 0319244 | A2 | 6/1989 |
| EP | 0324229 | A2 | 7/1989 |
| EP | 0324229 | B1 | 7/1992 |
| EP | 0539317 | A1 | 4/1993 |
| EP | 0556946 | A1 | 8/1993 |
| EP | 0559251 | A1 | 9/1993 |
| EP | 0585183 | A1 | 3/1994 |
| EP | 0319244 | B1 | 5/1994 |
| EP | 0661246 | A1 | 7/1995 |
| EP | 0539317 | B1 | 11/1995 |
| EP | 0715913 | A1 | 6/1996 |
| EP | 0725606 | A1 | 8/1996 |
| EP | 0750956 | A2 | 1/1997 |
| EP | 0750957 | A1 | 1/1997 |
| EP | 0792409 | A1 | 9/1997 |
| EP | 0691894 | B1 | 10/1997 |
| EP | 0805729 | A2 | 11/1997 |
| EP | 0818256 | A1 | 1/1998 |
| EP | 0556946 | B1 | 4/1998 |
| EP | 0559251 | B1 | 12/1998 |
| EP | 0585183 | B1 | 3/1999 |
| EP | 0899039 | A2 | 3/1999 |
| EP | 0750956 | B1 | 5/1999 |
| EP | 0661246 | B1 | 9/1999 |
| EP | 0725606 | B1 | 12/1999 |
| EP | 0968062 | A1 | 1/2000 |
| EP | 0805729 | B1 | 8/2000 |
| EP | 1055800 | A2 | 11/2000 |
| EP | 1070829 | A2 | 1/2001 |
| EP | 1124509 | A1 | 8/2001 |
| EP | 1142658 | A1 | 10/2001 |
| EP | 1161307 | A1 | 12/2001 |
| EP | 1163970 | A1 | 12/2001 |
| EP | 1178769 | A1 | 2/2002 |
| EP | 0715913 | B1 | 4/2002 |
| EP | 0968062 | B1 | 5/2002 |
| EP | 3951579 | B1 | 1/2003 |
| EP | 1284338 | A2 | 2/2003 |
| EP | 0750957 | B1 | 3/2003 |
| EP | 1341481 | A2 | 9/2003 |
| EP | 1358958 | A1 | 11/2003 |
| EP | 1367224 | A1 | 12/2003 |
| EP | 0818256 | B1 | 2/2004 |
| EP | 1124509 | B1 | 3/2004 |
| EP | 1425483 | A2 | 6/2004 |
| EP | 1055800 | B1 | 10/2004 |
| EP | 1163970 | B1 | 3/2005 |
| EP | 1358958 | B1 | 3/2005 |
| EP | 1519116 | A1 | 3/2005 |
| EP | 1531019 | A1 | 5/2005 |
| EP | 3899039 | B1 | 11/2005 |
| EP | 1604753 | A1 | 12/2005 |
| EP | 1659264 | A2 | 5/2006 |
| EP | 1178769 | B1 | 7/2006 |
| EP | 1382403 | B1 | 9/2006 |
| EP | 1759788 | A2 | 3/2007 |
| EP | 1764171 | A1 | 3/2007 |
| EP | 1813775 | A2 | 8/2007 |
| EP | 1815923 | A1 | 8/2007 |
| EP | 1849965 | A2 | 10/2007 |
| EP | 1070829 | B1 | 1/2008 |
| EP | 1142658 | B1 | 3/2008 |
| EP | 1927414 | A2 | 6/2008 |
| EP | 1930097 | A1 | 6/2008 |
| EP | 1930098 | A1 | 6/2008 |
| EP | 1930099 | A1 | 6/2008 |
| EP | 1932604 | A1 | 6/2008 |
| EP | 1936118 | A2 | 6/2008 |
| EP | 1939400 | A2 | 7/2008 |
| EP | 1984162 | A1 | 10/2008 |
| EP | 1604753 | B1 | 11/2008 |
| EP | 2000234 | A2 | 12/2008 |
| EP | 2025869 | A1 | 2/2009 |
| EP | 1531019 | B1 | 3/2010 |
| EP | 2212040 | A1 | 8/2010 |
| EP | 2246133 | A1 | 11/2010 |
| EP | 2025869 | B1 | 12/2010 |
| EP | 2335845 | A1 | 6/2011 |
| EP | 2336493 | A2 | 6/2011 |
| EP | 2336494 | A2 | 6/2011 |
| EP | 1930097 | B1 | 7/2011 |
| EP | 2362822 | A2 | 9/2011 |
| EP | 2366476 | A1 | 9/2011 |
| EP | 2392774 | A1 | 12/2011 |
| EP | 1930098 | B1 | 2/2012 |
| EP | 2445668 | A2 | 5/2012 |
| EP | 2445669 | A2 | 5/2012 |
| EP | 2461922 | A1 | 6/2012 |
| EP | 1659264 | B1 | 11/2012 |
| EP | 2519367 | A2 | 11/2012 |
| EP | 2537606 | A1 | 12/2012 |
| EP | 1927414 | B1 | 1/2013 |
| EP | 2549186 | A2 | 1/2013 |
| EP | 2551592 | A2 | 1/2013 |
| EP | 2551593 | A2 | 1/2013 |
| EP | 2559533 | A2 | 2/2013 |
| EP | 2559534 | A2 | 2/2013 |
| EP | 2559535 | A2 | 2/2013 |
| EP | 2576099 | A1 | 4/2013 |
| EP | 2000234 | B1 | 7/2013 |
| EP | 2614902 | A2 | 7/2013 |

(56) References Cited

FOREIGN PATENT DOCUMENTS

| | | | |
|---|---|---|---|
| EP | 2650062 | A2 | 10/2013 |
| EP | 2246133 | B1 | 7/2014 |
| EP | 2366476 | B1 | 7/2014 |
| EP | 2777841 | A1 | 9/2014 |
| EP | 1849965 | B1 | 2/2015 |
| EP | 2834031 | A2 | 2/2015 |
| EP | 1341481 | B1 | 3/2015 |
| EP | 2841710 | A1 | 3/2015 |
| EP | 2855857 | A2 | 4/2015 |
| EP | 2880276 | A1 | 6/2015 |
| EP | 2937161 | A1 | 10/2015 |
| GB | 7131292 | A | 6/1955 |
| GB | 800228 | A | 8/1958 |
| GB | 2102317 | A | 2/1983 |
| GB | 2118078 | A | 10/1983 |
| JP | H1052731 | A | 2/1998 |
| NO | 2015006026 | A1 | 1/2015 |
| NO | 2015080854 | A1 | 6/2015 |
| WO | 9615866 | A1 | 5/1996 |
| WO | 9618022 | A1 | 6/1996 |
| WO | 2010036801 | A2 | 4/2010 |
| WO | 2010040746 | A1 | 4/2010 |
| WO | 2010151833 | A2 | 12/2010 |
| WO | 2010151838 | A2 | 12/2010 |
| WO | 2011019667 | A1 | 2/2011 |
| WO | 2013163020 | A1 | 10/2013 |
| WO | 2014011262 | A2 | 1/2014 |
| WO | 2014022255 | A1 | 2/2014 |
| WO | 2014028095 | A2 | 2/2014 |
| WO | 2014093826 | A2 | 6/2014 |
| WO | 2014105108 | A1 | 7/2014 |
| WO | 2014109819 | A1 | 7/2014 |
| WO | 2014133635 | A2 | 9/2014 |
| WO | 2014179381 | A1 | 11/2014 |
| WO | 2015006440 | A1 | 1/2015 |
| WO | 2015006479 | A1 | 1/2015 |
| WO | 2015009448 | A1 | 1/2015 |
| WO | 2015042089 | A1 | 3/2015 |
| WO | 2015050987 | A1 | 4/2015 |
| WO | 2015053833 | A1 | 4/2015 |
| WO | 2015073068 | A1 | 5/2015 |
| WO | 2015073657 | A1 | 5/2015 |
| WO | 2015094636 | A1 | 6/2015 |

OTHER PUBLICATIONS

European Search Report and Opinion issued in connection with related EP Application No. 16202422.8 dated May 8, 2017.

European Search Report and Opinion issued in connection with related EP Application No. 16204602.3 dated May 12, 2017.

European Search Report and Opinion issued in connection with related EP Application No. 16204609.8 May 12, 2017.

European Search Report and Opinion issued in connection with related EP Application No. 16204610.6 dated May 12, 2017.

European Search Report and Opinion issued in connection with related EP Application No. 16204613.0 dated May 22, 2017.

European Search Report and Opinion issued in connection with corresponding EP Application No. 16204605.6 dated May 26, 2017.

European Search Report and Opinion issued in connection with related EP Application No. 16204607.2 dated May 26, 2017.

European Search Report and Opinion issued in connection with related EP Application No. 16204608.0 dated May 26, 2017.

European Search Report and Opinion issued in connection with related EP Application No. 16204617.1 dated May 26, 2017.

European Search Report and Opinion issued in connection with related EP Application No. 16204614.8.0 dated Jun. 2, 2017.

Liu et al, "Effect of nickel coating on bending properties of stereolithography photo-polymer SL5195", Materials & Design, vol. 26, Issue 6, pp. 493-496, 2005.

Extended EP Search Report for related application 16204610.6 dated May 12, 2017 (5 pgs).

European Search Report and Opinion issued in connection with related EP Application No. 17168418.6 dated Aug. 10, 2017.

METHOD AND ASSEMBLY FOR FORMING COMPONENTS HAVING INTERNAL PASSAGES USING A JACKETED CORE

BACKGROUND

The field of the disclosure relates generally to components having an internal passage defined therein, and more particularly to forming such components using a jacketed core.

Some components require an internal passage to be defined therein, for example, in order to perform an intended function. For example, but not by way of limitation, some components, such as hot gas path components of gas turbines, are subjected to high temperatures. At least some such components have internal passages defined therein to receive a flow of a cooling fluid, such that the components are better able to withstand the high temperatures. For another example, but not by way of limitation, some components are subjected to friction at an interface with another component. At least some such components have internal passages defined therein to receive a flow of a lubricant to facilitate reducing the friction.

At least some known components having an internal passage defined therein are formed in a mold, with a core of ceramic material extending within the mold cavity at a location selected for the internal passage. After a molten metal alloy is introduced into the mold cavity around the ceramic core and cooled to form the component, the ceramic core is removed, such as by chemical leaching, to form the internal passage. However, at least some known ceramic cores are fragile, resulting in cores that are difficult and expensive to produce and handle without damage. In addition, some molds used to form such components are formed by investment casting, and at least some known ceramic cores lack sufficient strength to reliably withstand injection of a material, such as, but not limited to, wax, used to form a pattern for the investment casting process. Moreover, effective removal of at least some ceramic cores from the cast component is difficult and time-consuming, particularly for, but not limited to, components for which as a ratio of length-to-diameter of the core is large and/or the core is substantially nonlinear.

Alternatively or additionally, at least some known components having an internal passage defined therein are initially formed without the internal passage, and the internal passage is formed in a subsequent process. For example, at least some known internal passages are formed by drilling the passage into the component, such as, but not limited to, using an electrochemical drilling process. However, at least some such drilling processes are relatively time-consuming and expensive. Moreover, at least some such drilling processes cannot produce an internal passage curvature required for certain component designs.

BRIEF DESCRIPTION

In one aspect, a method of forming a component having an internal passage defined therein is provided. The method includes positioning a jacketed core with respect to a mold. The jacketed core includes a hollow structure formed from a first material, an inner core disposed within the hollow structure, and a core channel that extends from at least a first end of the inner core through at least a portion of inner core. The method also includes introducing a component material in a molten state into a cavity of the mold, such that the component material in the molten state at least partially absorbs the first material from the jacketed core within the cavity. The method further includes cooling the component material in the cavity to form the component. The inner core defines the internal passage within the component.

In another aspect, a mold assembly for use in forming a component having an internal passage defined therein is provided. The component is formed from a component material. The mold assembly includes a mold defining a mold cavity therein, and a jacketed core positioned with respect to the mold. The jacketed core includes a hollow structure formed from a first material, an inner core disposed within the hollow structure, and a core channel that extends from at least a first end of the inner core through at least a portion the inner core. The first material is at least partially absorbable by the component material in a molten state. A portion of the jacketed core is positioned within the mold cavity such that the inner core of the portion of the jacketed core defines a position of the internal passage within the component.

DRAWINGS

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms such as "about," "approximately," and "substantially" is not to be limited to the precise value specified. In at least some instances, the approximating language may correspond to the precision of an instrument for measuring the value. Here and throughout the specification and claims, range limitations may be identified. Such ranges may be combined and/or interchanged, and include all the sub-ranges contained therein unless context or language indicates otherwise.

The exemplary components and methods described herein overcome at least some of the disadvantages associated with known assemblies and methods for forming a component having an internal passage defined therein. The embodiments described herein provide a jacketed core positioned with respect to a mold. The jacketed core includes (i) a hollow structure formed from a first material, (ii) an inner core disposed within the hollow structure, and (iii) a core channel that extends within the inner core. The inner core extends within the mold cavity to define a position of the internal passage within the component to be formed in the mold. The first material is selected to be substantially absorbable by a component material introduced into the mold cavity to form the component. After the component is formed, the core channel provides a path for a fluid to contact the inner core to facilitate removal of the inner core from the formed component. In certain embodiments, the jacketed core is initially formed with a wire embedded in the inner core, and the wire defines the core channel. The wire is removable from the jacketed core prior to or after casting the component.

Figure 1:
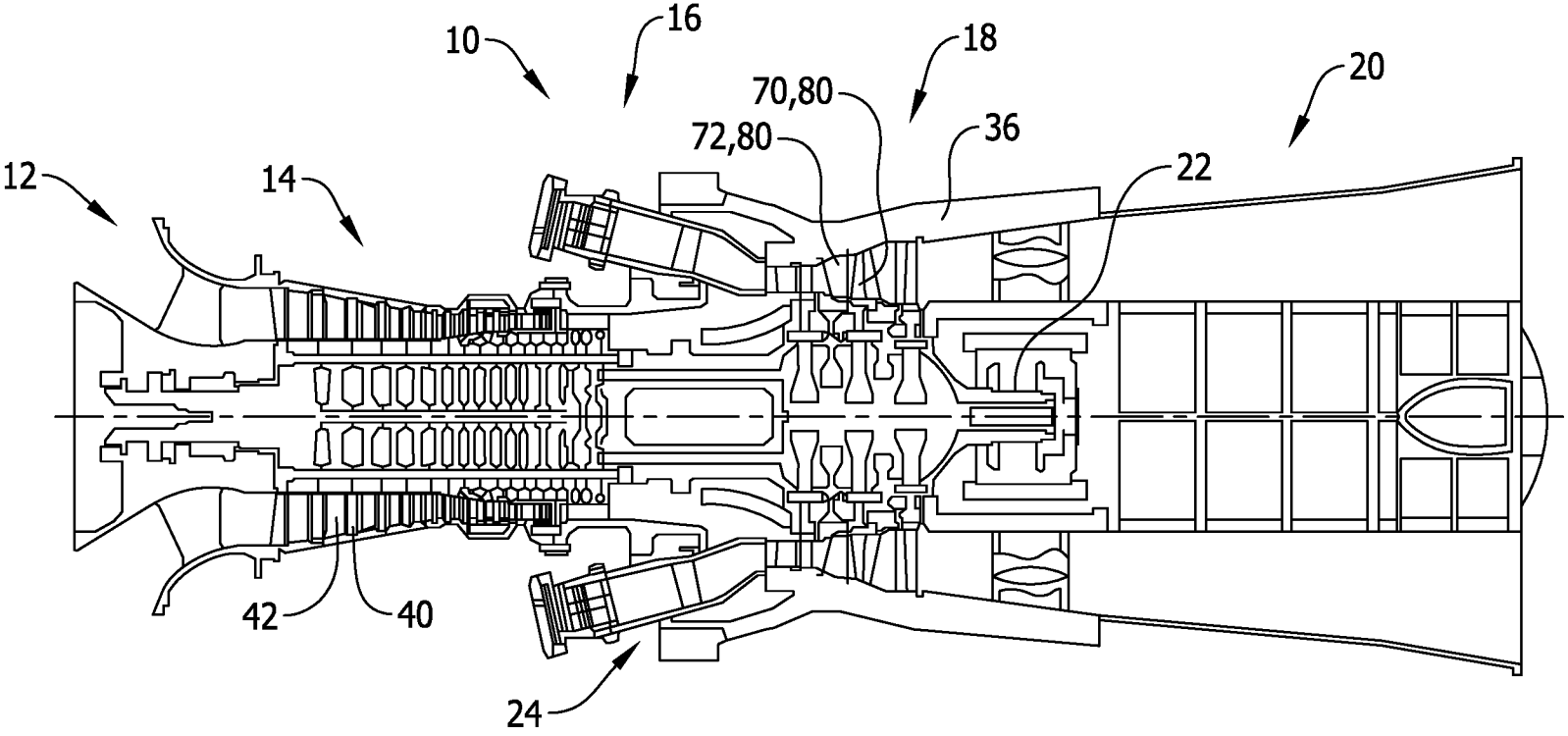
FIG. 1 is a schematic diagram of an exemplary rotary machine.

FIG. 1 is a schematic view of an exemplary rotary machine 10 having components for which embodiments of the current disclosure may be used. In the exemplary embodiment, rotary machine 10 is a gas turbine that includes an intake section 12, a compressor section 14 coupled downstream from intake section 12, a combustor section 16 coupled downstream from compressor section 14, a turbine section 18 coupled downstream from combustor section 16, and an exhaust section 20 coupled downstream from turbine section 18. A generally tubular casing 36 at least partially encloses one or more of intake section 12, compressor section 14, combustor section 16, turbine section 18, and exhaust section 20. In alternative embodiments, rotary machine 10 is any rotary machine for which components formed with internal passages as described herein are suitable. Moreover, although embodiments of the present disclosure are described in the context of a rotary machine for purposes of illustration, it should be understood that the embodiments described herein are applicable in any context that involves a component suitably formed with an internal passage defined therein.

In the exemplary embodiment, turbine section 18 is coupled to compressor section 14 via a rotor shaft 22. It should be noted that, as used herein, the term "couple" is not limited to a direct mechanical, electrical, and/or communication connection between components, but may also include an indirect mechanical, electrical, and/or communication connection between multiple components.

During operation of rotary machine 10, intake section 12 channels air towards compressor section 14. Compressor section 14 compresses the air to a higher pressure and temperature. More specifically, rotor shaft 22 imparts rotational energy to at least one circumferential row of compressor blades 40 coupled to rotor shaft 22 within compressor section 14. In the exemplary embodiment, each row of compressor blades 40 is preceded by a circumferential row of compressor stator vanes 42 extending radially inward from casing 36 that direct the air flow into compressor blades 40. The rotational energy of compressor blades 40 increases a pressure and temperature of the air. Compressor section 14 discharges the compressed air towards combustor section 16.

In combustor section 16, the compressed air is mixed with fuel and ignited to generate combustion gases that are channeled towards turbine section 18. More specifically, combustor section 16 includes at least one combustor 24, in which a fuel, for example, natural gas and/or fuel oil, is injected into the air flow, and the fuel-air mixture is ignited to generate high temperature combustion gases that are channeled towards turbine section 18.

Turbine section 18 converts the thermal energy from the combustion gas stream to mechanical rotational energy. More specifically, the combustion gases impart rotational energy to at least one circumferential row of rotor blades 70 coupled to rotor shaft 22 within turbine section 18. In the exemplary embodiment, each row of rotor blades 70 is preceded by a circumferential row of turbine stator vanes 72 extending radially inward from casing 36 that direct the combustion gases into rotor blades 70. Rotor shaft 22 may be coupled to a load (not shown) such as, but not limited to, an electrical generator and/or a mechanical drive application. The exhausted combustion gases flow downstream from turbine section 18 into exhaust section 20. Components of rotary machine 10 are designated as components 80. Components 80 proximate a path of the combustion gases are subjected to high temperatures during operation of rotary machine 10. Additionally or alternatively, components 80 include any component suitably formed with an internal passage defined therein.

Figure 2:
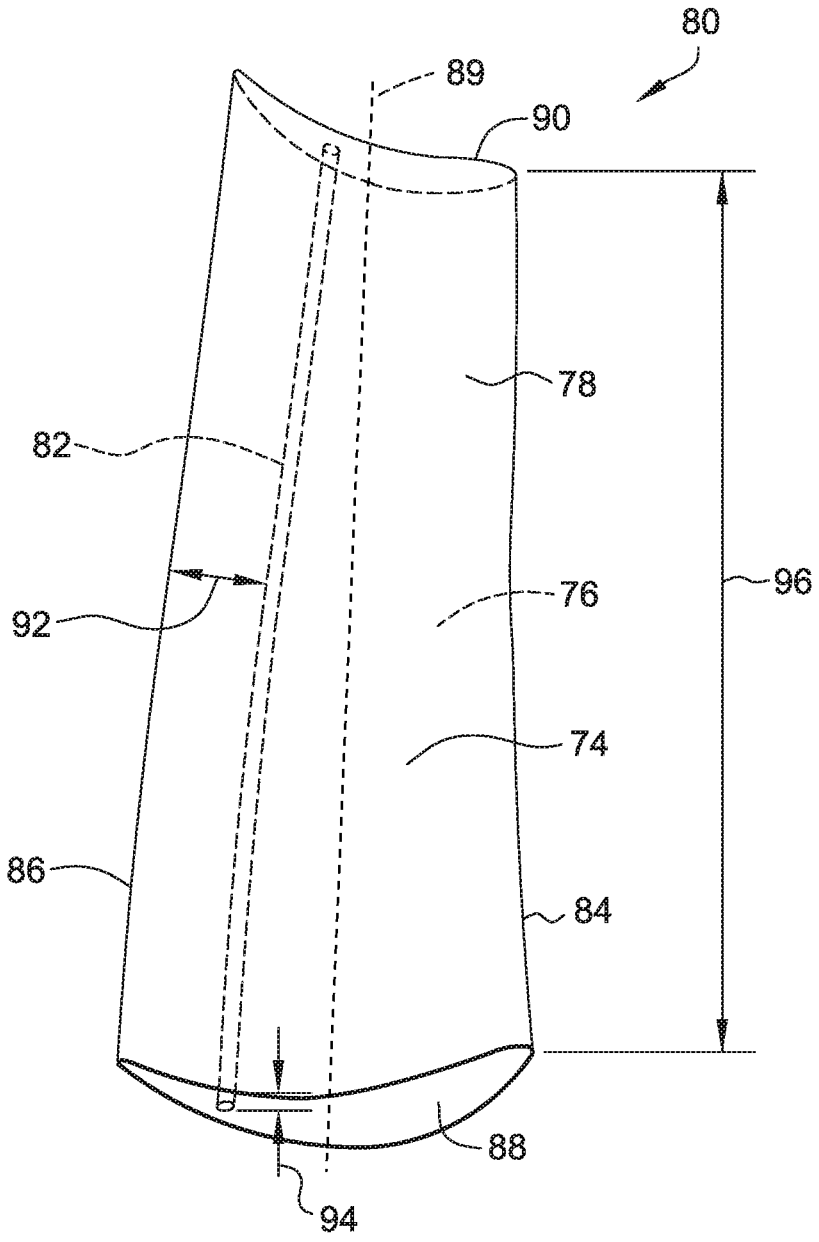
FIG. 2 is a schematic perspective view of an exemplary component for use with the rotary machine shown in FIG. 1.

FIG. 2 is a schematic perspective view of an exemplary component 80, illustrated for use with rotary machine 10 (shown in FIG. 1). Component 80 includes at least one internal passage 82 defined therein. For example, a cooling fluid is provided to internal passage 82 during operation of rotary machine 10 to facilitate maintaining component 80 below a temperature of the hot combustion gases. Although only one internal passage 82 is illustrated, it should be understood that component 80 includes any suitable number of internal passages 82 formed as described herein.

Component 80 is formed from a component material 78. In the exemplary embodiment, component material 78 is a suitable nickel-based superalloy. In alternative embodiments, component material 78 is at least one of a cobalt-based superalloy, an iron-based alloy, and a titanium-based alloy. In other alternative embodiments, component material 78 is any suitable material that enables component 80 to be formed as described herein.

In the exemplary embodiment, component 80 is one of rotor blades 70 or stator vanes 72. In alternative embodiments, component 80 is another suitable component of rotary machine 10 that is capable of being formed with an internal passage as described herein. In still other embodiments, component 80 is any component for any suitable application that is suitably formed with an internal passage defined therein.

In the exemplary embodiment, rotor blade 70, or alternatively stator vane 72, includes a pressure side 74 and an opposite suction side 76. Each of pressure side 74 and suction side 76 extends from a leading edge 84 to an opposite trailing edge 86. In addition, rotor blade 70, or alternatively stator vane 72, extends from a root end 88 to an opposite tip end 90, defining a blade length 96. In alternative embodiments, rotor blade 70, or alternatively stator vane 72, has any suitable configuration that is capable of being formed with an internal passage as described herein.

In certain embodiments, blade length 96 is at least about 25.4 centimeters (cm) (10 inches). Moreover, in some embodiments, blade length 96 is at least about 50.8 cm (20 inches). In particular embodiments, blade length 96 is in a range from about 61 cm (24 inches) to about 101.6 cm (40 inches). In alternative embodiments, blade length 96 is less than about 25.4 cm (10 inches). For example, in some embodiments, blade length 96 is in a range from about 2.54 cm (1 inch) to about 25.4 cm (10 inches). In other alternative embodiments, blade length 96 is greater than about 101.6 cm (40 inches).

In the exemplary embodiment, internal passage 82 extends from root end 88 to tip end 90. In alternative embodiments, internal passage 82 extends within component 80 in any suitable fashion, and to any suitable extent, that enables internal passage 82 to be formed as described herein. In certain embodiments, internal passage 82 is nonlinear. For example, component 80 is formed with a predefined twist along an axis 89 defined between root end 88 and tip end 90, and internal passage 82 has a curved shape complementary to the axial twist. In some embodiments, internal passage 82 is positioned at a substantially constant distance 94 from pressure side 74 along a length of internal passage 82. Alternatively or additionally, a chord of component 80 tapers between root end 88 and tip end 90, and internal passage 82 extends nonlinearly complementary to the taper, such that internal passage 82 is positioned at a substantially constant distance 92 from trailing edge 86 along the length of internal passage 82. In alternative embodiments, internal passage 82 has a nonlinear shape that is complementary to any suitable contour of component 80. In other alternative embodiments, internal passage 82 is nonlinear and other than complementary to a contour of component 80. In some embodiments, internal passage 82 having a nonlinear shape facilitates satisfying a preselected cooling criterion for component 80. In alternative embodiments, internal passage 82 extends linearly.

In some embodiments, internal passage 82 has a substantially circular cross-section. In alternative embodiments, internal passage 82 has a substantially ovoid cross-section. In other alternative embodiments, internal passage 82 has any suitably shaped cross-section that enables internal passage 82 to be formed as described herein. Moreover, in certain embodiments, the shape of the cross-section of internal passage 82 is substantially constant along a length of internal passage 82. In alternative embodiments, the shape of the cross-section of internal passage 82 varies along a length of internal passage 82 in any suitable fashion that enables internal passage 82 to be formed as described herein.

Figure 3:
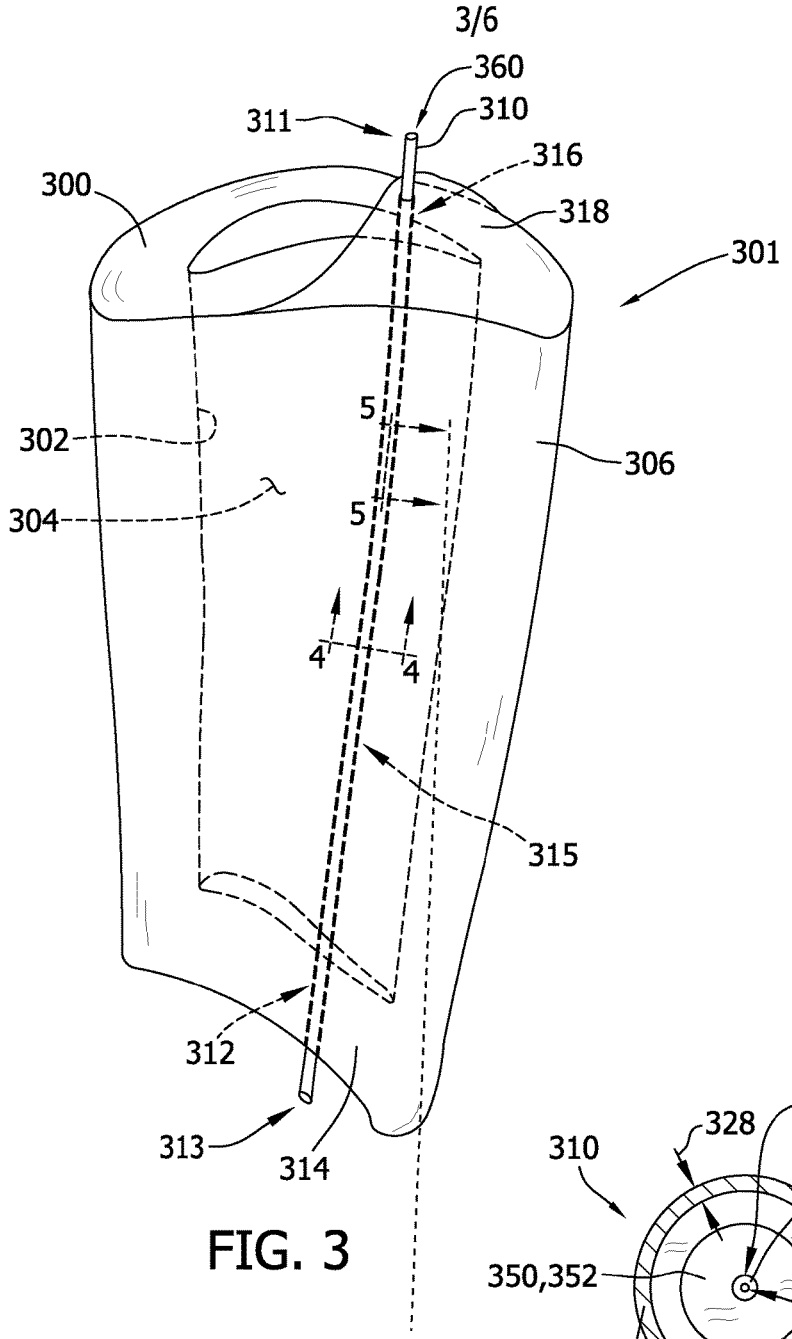
FIG. 3 is a schematic perspective view of an exemplary mold assembly for making the component shown in FIG. 2, the mold assembly including a jacketed core positioned with respect to a mold.
Figure 4:
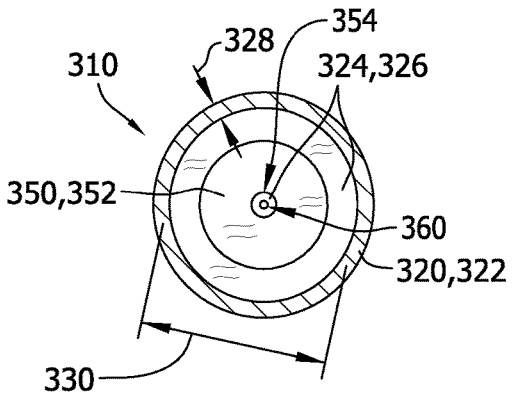
FIG. 4 is a schematic cross-section of an exemplary jacketed core for use with the mold assembly shown in FIG. 3, taken along lines 4-4 shown in FIG. 3.
Figure 5:
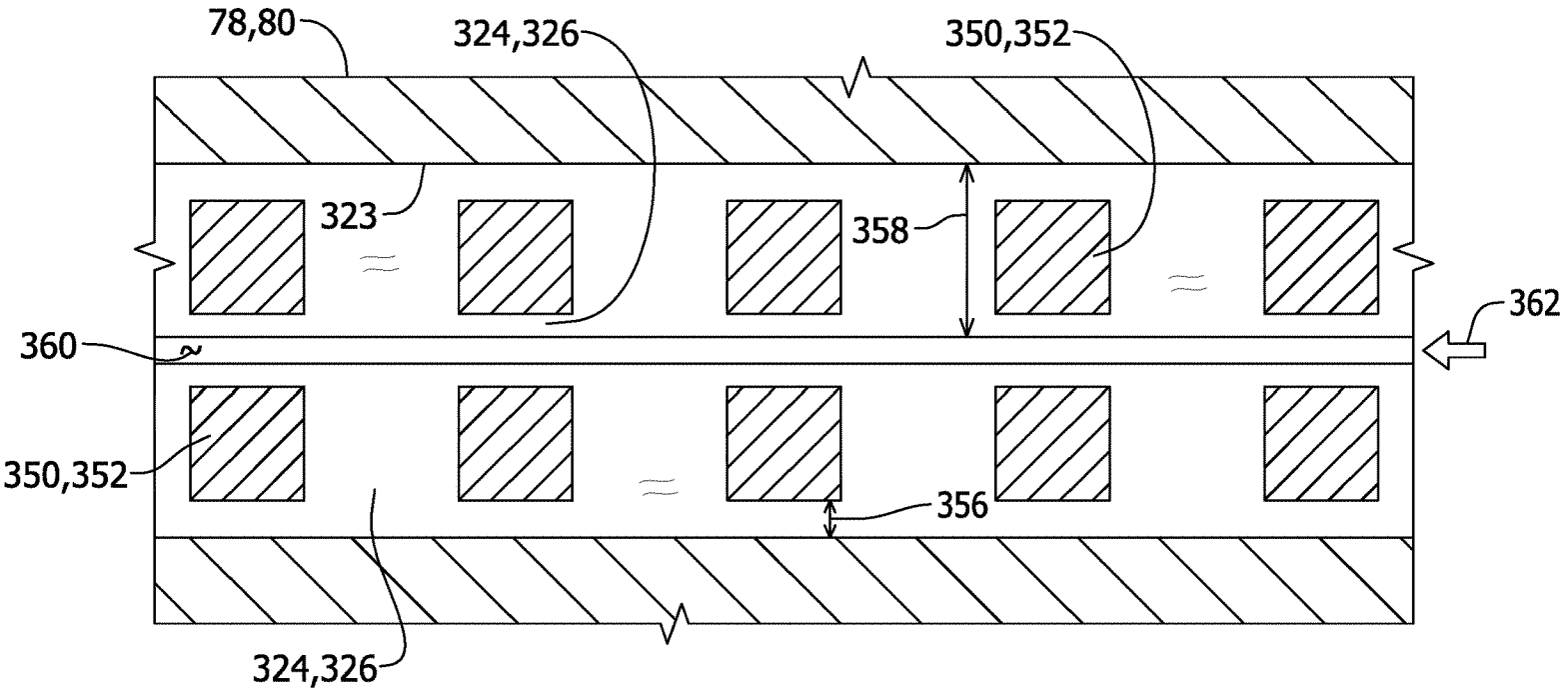
FIG. 5 is a schematic cross-section of the exemplary jacketed core of FIG. 3 taken along lines 5-5 shown in FIG. 3.

FIG. 3 is a schematic perspective view of a mold assembly 301 for making component 80 (shown in FIG. 2). Mold assembly 301 includes a jacketed core 310 positioned with respect to a mold 300. FIG. 4 is a schematic cross-section of jacketed core 310 taken along lines 4-4 shown in FIG. 3. FIG. 5 is a schematic cross-section of jacketed core 310 taken along lines 5-5 shown in FIG. 3. With reference to FIGS. 2-5, an interior wall 302 of mold 300 defines a mold cavity 304. Interior wall 302 defines a shape corresponding to an exterior shape of component 80. It should be recalled that, although component 80 in the exemplary embodiment is rotor blade 70 or, alternatively, stator vane 72, in alternative embodiments component 80 is any component suitably formable with an internal passage defined therein, as described herein.

Jacketed core 310 is positioned with respect to mold 300 such that a portion 315 of jacketed core 310 extends within mold cavity 304. Jacketed core 310 includes a hollow structure 320 formed from a first material 322, and an inner core 324 disposed within hollow structure 320 and formed from an inner core material 326. Inner core 324 is shaped to define a shape of internal passage 82, and inner core 324 of portion 315 of jacketed core 310 positioned within mold cavity 304 defines internal passage 82 within component 80 when component 80 is formed.

Inner core 324 extends from a first end 311 to an opposite second end 313. In the illustrated embodiment, first end 311 is positioned proximate an open end of mold cavity 304, and second end 313 extends outwardly from mold 300 opposite first end 311. However, the designation of first end 311 and second end 313 is not intended to limit the disclosure. For example, in alternative embodiments, second end 313 is positioned proximate the open end of mold cavity 304, and first end 311 extends out of mold 300 opposite first end 311. Moreover, the illustrated positions of first end 311 and second end 313 are not intended to limit the disclosure. For example, in alternative embodiments, each of first end 311 and second end 313 is positioned proximate the open end of mold cavity 304, such that inner core 324 forms a U-shape within mold cavity 304. For another example, in other alternative embodiments, at least one of first end 311 and second end 313 is positioned within mold cavity 304. For another example, in other alternative embodiments, at least one of first end 311 and second end 313 is embedded within a wall of mold cavity 300. For another example, in other alternative embodiments, at least one of first end 311 and second end 313 extends outwardly from any suitable location on mold 300.

In certain embodiments, component 80 is formed by adding component material 78 in a molten state to mold cavity 304, such that hollow structure 320 is at least partially absorbed by molten component material 78. Component material 78 is cooled within mold cavity 304 to form component 80, and inner core 324 of portion 315 defines the position of internal passage 82 within component 80.

Mold 300 is formed from a mold material 306. In the exemplary embodiment, mold material 306 is a refractory ceramic material selected to withstand a high temperature environment associated with the molten state of component material 78 used to form component 80. In alternative embodiments, mold material 306 is any suitable material that enables component 80 to be formed as described herein. Moreover, in the exemplary embodiment, mold 300 is formed by a suitable investment casting process. For example, but not by way of limitation, a suitable pattern material, such as wax, is injected into a suitable pattern die to form a pattern (not shown) of component 80, the pattern is repeatedly dipped into a slurry of mold material 306 which is allowed to harden to create a shell of mold material 306, and the shell is dewaxed and fired to form mold 300. In alternative embodiments, mold 300 is formed by any suitable method that enables mold 300 to function as described herein.

Hollow structure 320 is shaped to substantially enclose inner core 324 along a length of inner core 324. In certain embodiments, hollow structure 320 defines a generally tubular shape. For example, but not by way of limitation, hollow structure 320 is initially formed from a substantially straight metal tube that is suitably manipulated into a nonlinear shape, such as a curved or angled shape, as necessary to define a selected nonlinear shape of inner core 324 and, thus, of internal passage 82. In alternative embodiments, hollow structure 320 defines any suitable shape that enables inner core 324 to define a shape of internal passage 82 as described herein.

In the exemplary embodiment, hollow structure 320 has a wall thickness 328 that is less than a characteristic width 330 of inner core 324. Characteristic width 330 is defined herein as the diameter of a circle having the same cross-sectional area as inner core 324. In alternative embodiments, hollow structure 320 has a wall thickness 328 that is other than less than characteristic width 330. A shape of a cross-section of inner core 324 is circular in the exemplary embodiment shown in FIGS. 3 and 4. Alternatively, the shape of the cross-section of inner core 324 corresponds to any suitable shape of the cross-section of internal passage 82 that enables internal passage 82 to function as described herein.

In the exemplary embodiment, inner core material 326 is a refractory ceramic material selected to withstand a high temperature environment associated with the molten state of component material 78 used to form component 80. For example, but without limitation, inner core material 326 includes at least one of silica, alumina, and mullite. Moreover, in the exemplary embodiment, inner core material 326 is selectively removable from component 80 to form internal passage 82. For example, but not by way of limitation, inner core material 326 is removable from component 80 by a suitable process that does not substantially degrade component material 78, such as, but not limited to, a suitable chemical leaching process. In certain embodiments, inner core material 326 is selected based on a compatibility with, and/or a removability from, component material 78. In alternative embodiments, inner core material 326 is any suitable material that enables component 80 to be formed as described herein.

In certain embodiments, jacketed core 310 further includes a plurality of spacers 350 positioned within hollow structure 320. Each spacer 350 is formed from a spacer material 352. In the exemplary embodiment, each spacer 350 defines a substantially annular disk shape. In alternative embodiments, each spacer 350 defines any suitable shape that enables spacers 350 to function as will be described herein.

Spacers 350 are substantially encased within inner core 324. For example, in the illustrated embodiment, each spacer 350 is positioned at an offset distance 356 from inner surface 323 of hollow structure 320. In some embodiments, offset distance 356 varies axially and/or circumferentially along at least one spacer 350, and/or offset distance 356 varies among spacers 350. In alternative embodiments, offset distance 356 is substantially constant axially and/or circumferentially along each spacer 350 and/or among spacers 350. In other alternative embodiments, at least one spacer 350 is in contact with inner surface 323 of hollow structure 320. It should be understood that each spacer 350 in contact with inner surface 323 of hollow structure 320 also is considered to be substantially encased within inner core 324 for purposes of this disclosure.

In the exemplary embodiment, spacer material 352 also is a refractory ceramic material selected to withstand a high temperature environment associated with the molten state of component material 78 used to form component 80. In certain embodiments, spacer material 352 is selected based on a compatibility with inner core material 326 and/or component material 78, and/or a removability from component material 78. More specifically, spacer material 352 is selectively removable from component 80 along with, and in the same fashion as, inner core material 326 to form internal passage 82. For example, spacer material 352 includes at least one of silica, alumina, and mullite. In some embodiments, spacer material 352 is selected to be substantially identical to inner core material 326. In alternative embodiments, spacer material 352 is any suitable material that enables component 80 to be formed as described herein.

In alternative embodiments, jacketed core 310 does not include spacers 350.

Jacketed core 310 also includes a core channel 360 that extends from at least first end 311 of inner core 324 through at least a portion of inner core 324. In the exemplary embodiment, core channel 360 extends from first end 311 through second end 313 of inner core 324. In alternative embodiments, core channel 360 terminates at a location within inner core 324 that is between first end 311 and second end 313. Core channel 360 is offset from inner surface 323 of hollow structure 320 by a nonzero offset distance 358. In some embodiments, offset distance 358 varies axially and/or circumferentially along core channel 360. In alternative embodiments, offset distance 358 is substantially constant axially and/or circumferentially along core channel 360. In certain embodiments in which spacers 350 are embedded in inner core 324, core channel 360 extends through spacers 350 within inner core 324. For example, in the exemplary embodiment, each spacer 350 defines a spacer opening 354 that extends through spacer 350, and core channel 360 is defined through spacer opening 354 of each of spacers 350.

In some embodiments, core channel 360 facilitates removal of inner core 324 from component 80 to form internal passage 82. For example, inner core 324 is removable from component 80 through application of a fluid 362 to inner core material 326. More specifically, fluid 362 is flowed into core channel 360 defined in inner core 324. For example, but not by way of limitation, inner core material 326 is a ceramic material, and fluid 362 is configured to interact with inner core material 326 such that inner core 324 is leached from component 80 through contact with fluid 362. Core channel 360 enables fluid 362 to be applied directly to inner core material 326 along a length of inner core 324. In contrast, for an inner core (not shown) that does not include core channel 360, fluid 362 generally can only be applied at any one time to a cross-sectional area of the inner core defined by characteristic width 330. Thus, core channel 360 greatly increases a surface area of inner core 324 that is simultaneously exposed to fluid 362, decreasing a time required for, and increasing an effectiveness of, removal of inner core 324. Additionally or alternatively, in certain embodiments in which inner core 324 has a large length-to-diameter ratio (L/d) and/or is substantially nonlinear, core channel 360 extending within inner core 324 facilitates application of fluid 362 to portions of inner core 324 that would be difficult to reach for an inner core that does not include core channel 360. As one example, core channel 360 extends from first end 311 to second end 313 of inner core 324, and fluid 362 is flowed under pressure within core channel 360 from first end 311 to second end 313 to facilitate removal of inner core 324 along a full length of inner core 324.

In addition, in certain embodiments in which spacers 350 are encased in inner core 324, core channel 360 also facilitates removal of spacer material 352 from component 80 in substantially identical fashion as described above for removal of inner core material 326.

In certain embodiments, jacketed core 310 is secured relative to mold 300 such that jacketed core 310 remains fixed relative to mold 300 during a process of forming component 80. For example, jacketed core 310 is secured such that a position of jacketed core 310 does not shift during introduction of molten component material 78 into mold cavity 304 surrounding jacketed core 310. In some embodiments, jacketed core 310 is coupled directly to mold 300. For example, in the exemplary embodiment, a tip portion 312 of jacketed core 310 is rigidly encased in a tip portion 314 of mold 300. Also in the exemplary embodiment, a root portion 316 of jacketed core 310 is rigidly encased in a root portion 318 of mold 300 opposite tip portion 314. For example, but not by way of limitation, mold 300 is formed by investment casting as described above, and jacketed core 310 is securely coupled to the suitable pattern die such that tip portion 312 and root portion 316 extend out of the pattern die, while portion 315 extends within a cavity of the die. The pattern material is injected into the die around jacketed core 310 such that portion 315 extends within the pattern. The investment casting causes mold 300 to encase tip portion 312 and/or root portion 316. Additionally or alternatively, jacketed core 310 is secured relative to mold 300 in any other suitable fashion that enables the position of jacketed core 310 relative to mold 300 to remain fixed during a process of forming component 80.

First material 322 is selected to be at least partially absorbable by molten component material 78. In certain embodiments, component material 78 is an alloy, and first material 322 is at least one constituent material of the alloy. For example, in the exemplary embodiment, component material 78 is a nickel-based superalloy, and first material 322 is substantially nickel, such that first material 322 is substantially absorbable by component material 78 when component material 78 in the molten state is introduced into mold cavity 304. In alternative embodiments, component material 78 is any suitable alloy, and first material 322 is at least one material that is at least partially absorbable by the molten alloy. For example, component material 78 is a cobalt-based superalloy, and first material 322 is substantially cobalt. For another example, component material 78 is an iron-based alloy, and first material 322 is substantially iron. For another example, component material 78 is a titanium-based alloy, and first material 322 is substantially titanium.

In certain embodiments, wall thickness 328 is sufficiently thin such that first material 322 of portion 315 of jacketed core 310, that is, the portion that extends within mold cavity 304, is substantially absorbed by component material 78 when component material 78 in the molten state is introduced into mold cavity 304. For example, in some such embodiments, first material 322 is substantially absorbed by component material 78 such that no discrete boundary delineates hollow structure 320 from component material 78 after component material 78 is cooled. Moreover, in some such embodiments, first material 322 is substantially absorbed such that, after component material 78 is cooled, first material 322 is substantially uniformly distributed within component material 78. For example, a concentration of first material 322 proximate inner core 324 is not detectably higher than a concentration of first material 322 at other locations within component 80. For example, and without limitation, first material 322 is nickel and component material 78 is a nickel-based superalloy, and no detectable higher nickel concentration remains proximate inner core 324 after component material 78 is cooled, resulting in a distribution of nickel that is substantially uniform throughout the nickel-based superalloy of formed component 80.

In alternative embodiments, wall thickness 328 is selected such that first material 322 is other than substantially absorbed by component material 78. For example, in some embodiments, after component material 78 is cooled, first material 322 is other than substantially uniformly distributed within component material 78. For example, a concentration of first material 322 proximate inner core 324 is detectably higher than a concentration of first material 322 at other locations within component 80. In some such embodiments, first material 322 is partially absorbed by component material 78 such that a discrete boundary delineates hollow structure 320 from component material 78 after component material 78 is cooled. Moreover, in some such embodiments, first material 322 is partially absorbed by component material 78 such that at least a portion of hollow structure 320 proximate inner core 324 remains intact after component material 78 is cooled.

In some embodiments, hollow structure 320 substantially structurally reinforces inner core 324, thus reducing potential problems that would be associated with production, handling, and use of an unreinforced inner core 324 to form component 80 in some embodiments. For example, in certain embodiments, inner core 324 is a relatively brittle ceramic material subject to a relatively high risk of fracture, cracking, and/or other damage. Thus, in some such embodiments, forming and transporting jacketed core 310 presents a much lower risk of damage to inner core 324, as compared to using an unjacketed inner core 324. Similarly, in some such embodiments, forming a suitable pattern around jacketed core 310 to be used for investment casting of mold 300, such as by injecting a wax pattern material into a pattern die around jacketed core 310, presents a much lower risk of damage to inner core 324, as compared to using an unjacketed inner core 324. Thus, in certain embodiments, use of jacketed core 310 presents a much lower risk of failure to produce an acceptable component 80 having internal passage 82 defined therein, as compared to the same steps if performed using an unjacketed inner core 324 rather than jacketed core 310. Thus, jacketed core 310 facilitates obtaining advantages associated with positioning inner core 324 with respect to mold 300 to define internal passage 82, while reducing or eliminating fragility problems associated with inner core 324.

For example, in certain embodiments, such as, but not limited to, embodiments in which component 80 is rotor blade 70, characteristic width 330 of inner core 324 is within a range from about 0.050 cm (0.020 inches) to about 1.016 cm (0.400 inches), and wall thickness 328 of hollow structure 320 is selected to be within a range from about 0.013 cm (0.005 inches) to about 0.254 cm (0.100 inches). More particularly, in some such embodiments, characteristic width 330 is within a range from about 0.102 cm (0.040 inches) to about 0.508 cm (0.200 inches), and wall thickness 328 is selected to be within a range from about 0.013 cm (0.005 inches) to about 0.038 cm (0.015 inches). For another example, in some embodiments, such as, but not limited to, embodiments in which component 80 is a stationary component, such as but not limited to stator vane 72, characteristic width 330 of inner core 324 greater than about 1.016 cm (0.400 inches), and/or wall thickness 328 is selected to be greater than about 0.254 cm (0.100 inches). In alternative embodiments, characteristic width 330 is any suitable value that enables the resulting internal passage 82 to perform its intended function, and wall thickness 328 is selected to be any suitable value that enables jacketed core 310 to function as described herein.

Moreover, in certain embodiments, prior to introduction of inner core material 326 within hollow structure 320 to form jacketed core 310, hollow structure 320 is pre-formed to correspond to a selected nonlinear shape of internal passage 82. For example, first material 322 is a metallic material that is relatively easily shaped prior to filling with inner core material 326, thus reducing or eliminating a need to separately form and/or machine inner core 324 into a nonlinear shape. Moreover, in some such embodiments, the structural reinforcement provided by hollow structure 320 enables subsequent formation and handling of inner core 324 in a non-linear shape that would be difficult to form and handle as an unjacketed inner core 324. Thus, jacketed core 310 facilitates formation of internal passage 82 having a curved and/or otherwise non-linear shape of increased complexity, and/or with a decreased time and cost. In certain embodiments, hollow structure 320 is pre-formed to correspond to the nonlinear shape of internal passage 82 that is complementary to a contour of component 80. For example, but not by way of limitation, component 80 is one of rotor blade 70 and stator vane 72, and hollow structure 320 is pre-formed in a shape complementary to at least one of an axial twist and a taper of component 80, as described above.

Figure 6:
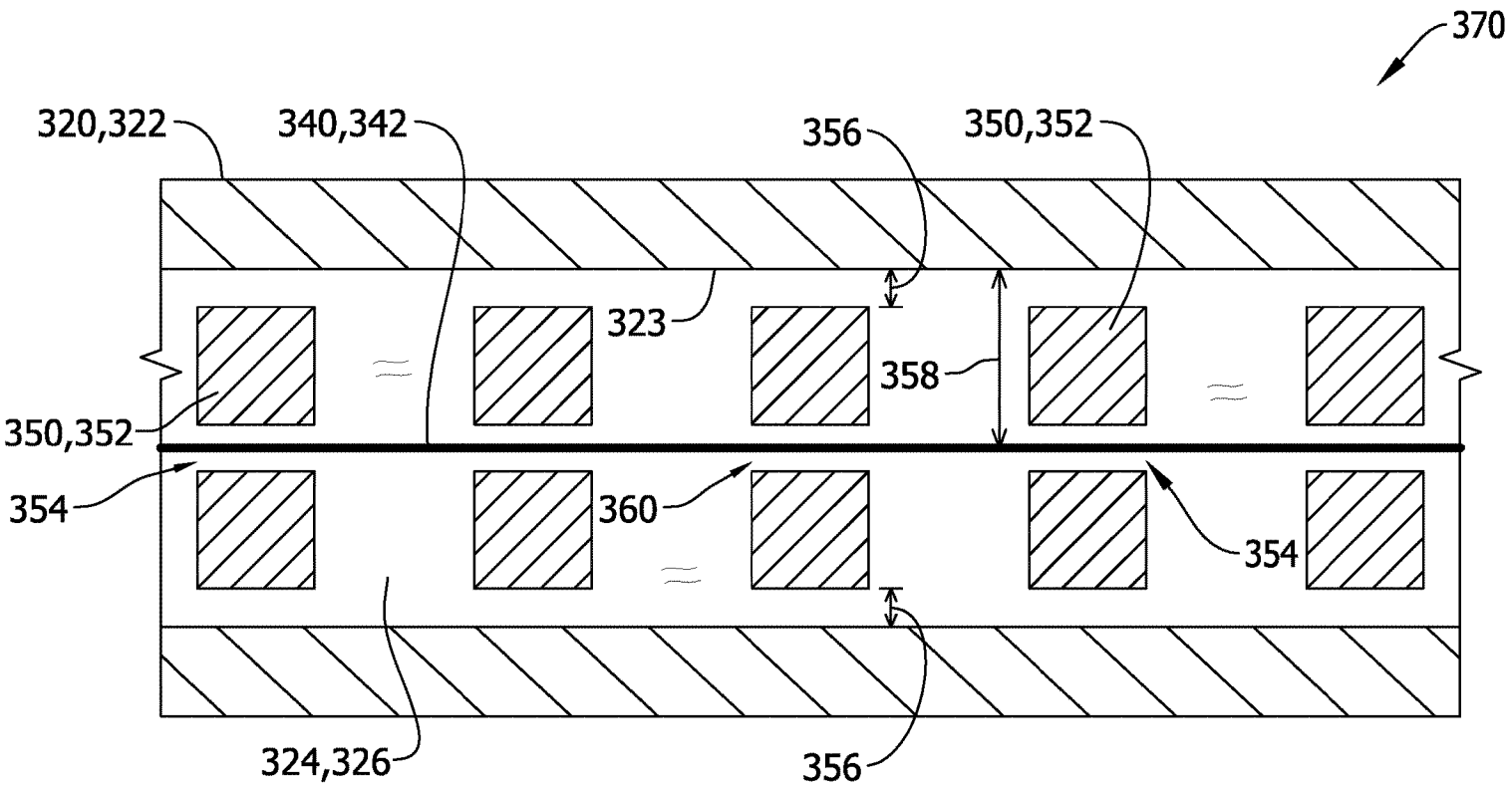
FIG. 6 is a schematic cross-section of an exemplary precursor jacketed core that may be used to form the jacketed core shown in FIGS. 3-5.

FIG. 6 is a schematic cross-section of an exemplary precursor jacketed core 370 that may be used to form jacketed core 310 shown in FIGS. 3-5. In the exemplary embodiment, precursor jacketed core 370 includes a wire 340 that extends from at least first end 311 of inner core 324 through at least a portion of inner core 324 and defines core channel 360. In the exemplary embodiment, wire 340 extends from at least first end 311 through second end 313 of inner core 324. In alternative embodiments, wire 340 terminates at a location within inner core 324 that is between first end 311 and second end 313. Wire 340 is formed from a second material 342.

In certain embodiments, second material 342 is selected to have a melting point that is substantially less than a melting point of first material 322. For example, but not by way of limitation, second material 342 is a polymer material that has a melting point that is substantially less than the melting point of first material 322. For another example, but not by way of limitation, second material 342 is a metal material, such as, but not limited to, tin, that has a melting point that is substantially less than the melting point of first material 322. In some such embodiments, second material 342 having a melting point that is substantially less than the melting point of first material 322 facilitates removal of wire 340 by melting second material 342 prior to casting component 80, as will be described herein. In alternative embodiments, second material 342 is selected to have a structural strength that enables wire 340 to be physically extracted from core channel 360 after inner core 324 is formed, as will be described herein. In still other alternative embodiments, second material 342 is any suitable material that enables core channel 360 to be formed as described herein.

In some embodiments, precursor jacketed core 370 is formed by positioning wire 340 within hollow structure 320 prior to formation of inner core 324 within hollow structure 320. In certain embodiments, spacers 350 are used to position wire 340 within hollow structure 320 such that core channel offset distance 358 is defined. More specifically, spacers 350 are configured to define offset distance 358 to inhibit contact, prior to and/or during introduction of inner core material 326 within hollow structure 320, between wire 340 and an inner surface 323 of hollow structure 320. For example, in the exemplary embodiment, each spacer 350 defines spacer opening 354 that extends through spacer 350, as described above, and is configured to receive wire 340 therethrough. Wire 340 is threaded through spacers 350, and spacers 350 threaded with wire 340 are positioned within hollow structure 320 prior to formation of inner core 324. In alternative embodiments, spacers 350 are configured in any suitable fashion that enables spacers 350 to function as described herein. In other alternative embodiments, precursor jacketed core 370 does not include spacers 350.

After wire 340 is positioned, inner core material 326 is added within hollow structure 320 such that inner core material 326 fills in around wire 340 and spacers 350, including within spacer openings 354, causing wire 340 and spacers 350 to become substantially encased within inner core 324, as described above. For example, but not by way of limitation, inner core material 326 is injected as a slurry into hollow structure 320, and inner core material 326 is dried within hollow structure 320 to form precursor jacketed core 370. After inner core 324 is formed, wire 340 defines, and is positioned within, core channel 360.

In certain embodiments, wire 340 is removed from precursor jacketed core 370 to form jacketed core 310 prior to forming component 80 in mold assembly 301. For example, precursor jacketed core 370 is heated separately to at or above the melting temperature of second material 342, and fluidized second material 342 is drained and/or suctioned from core channel 360 through first end 311 of inner core 324. Additionally or alternatively, in embodiments where core channel 360 extends to second end 313 of inner core 324, fluidized second material 342 is drained and/or suctioned from core channel 360 through second end 313.

For another example, precursor jacketed core 370 is positioned with respect to a pattern die (not shown) configured to form a pattern (not shown) of component 80. The pattern is formed in the pattern die from a pattern material, such as wax, and the precursor jacketed core 370 extends within the pattern. After the pattern is investment cast to create a shell of mold material 306, the shell is heated to above a melting temperature of the pattern material, suitable to remove the pattern material from the shell. Precursor jacketed core 370 extends within the pattern material and, thus, also is heated. Second material 342 is selected to have a melting temperature less than or equal to the melting temperature of the pattern material, such that wire 340 also melts. For example, second material 342 is a polymer. Fluidized second material 342 is drained and/or suctioned from core channel 360 through first end 311 of inner core 324. Additionally or alternatively, in embodiments where core channel 360 extends to second end 313 of inner core 324, fluidized second material 342 is drained and/or suctioned from core channel 360 through second end 313.

For another example, precursor jacketed core 370 is embedded in the pattern used to form mold assembly 301, as described above, and second material 342 is selected as a metal having a relatively low melting temperature, such as, but not limited to, tin. After the shell of mold material 306 is dewaxed, the shell is fired to form mold 300. Precursor jacketed core 370 extends within the shell and, thus, also is heated. A shell firing temperature is selected to be greater than the melting temperature of second material 342, such that second material 342 melts. Fluidized second material 342 is drained and/or suctioned from core channel 360 through first end 311 of inner core 324. Additionally or alternatively, in embodiments where core channel 360 extends to second end 313 of inner core 324, fluidized second material 342 is drained and/or suctioned from core channel 360 through second end 313.

Alternatively, in some embodiments, wire 340 is mechanically removed from precursor jacketed core 370 to form jacketed core 310. For example, a tension force is exerted on an end of wire 340 proximate first end 311 or second end 313 sufficient to disengage wire 340 from inner core 324 along core channel 360. For another example, a mechanical rooter device is snaked into core channel 360 to break up and/or dislodge inner core 324 and/or spacers 350 to facilitate physical extraction of wire 340. In some such embodiments, wire 340 is mechanically removed from precursor jacketed core 370 prior to forming component 80 in mold assembly 301. In other such embodiments, wire 340 is mechanically removed from precursor jacketed core 370 after forming component 80 in mold assembly 301.

In alternative embodiments, wire 340 is removed from precursor jacketed core 370 to form jacketed core 310 in any suitable fashion.

In some embodiments, removing wire 340 from precursor jacketed core 370 prior to forming component 80 in mold assembly 301 facilitates removal of wire 340 and/or formation of component 80 having selected properties. For example, in some such embodiments, if second material 342 were subjected to a heat associated with casting component 80 in mold 300, second material 342 would tend to bind with inner core material 326, increasing a difficulty of removing wire 340 from precursor jacketed core 370 after forming component 80 in mold assembly 301. For another example, in some such embodiments, fluidized second material 342 draining from first end 311 and/or second end 313 of inner core 324 during the component casting process would tend to cause second material 342 to be present with molten component material 78 within mold 304, potentially adversely affecting material properties of component 80. However, in alternative embodiments, wire 340 is removed from precursor jacketed core 370 after forming component 80 in mold assembly 301, as described above.

In certain embodiments, the use of spacers 350 to inhibit contact between wire 340 and inner surface 323 of hollow structure 320, such that offset distance 358 is defined between core channel 360 and inner surface 323 as described above, facilitates maintaining an integrity of inner core 324 during casting of component 80. For example, if a precursor jacketed core were formed such that core channel 360 is not offset from inner surface 323, and the adjacent portion of hollow structure 320 is substantially absorbed by molten component material 78 during casting of component 80, core channel 360 would then be in flow communication with molten component material 78. More specifically, molten material 78 could flow into core channel 360 within inner core 324, potentially forming an obstruction within internal passage 82 after component material 78 solidifies and inner core 324 is removed. The use of spacers 350 to define offset distance 358 reduces such a risk. Alternatively, precursor jacketed core 370 is formed without spacers 350.

Figure 7:
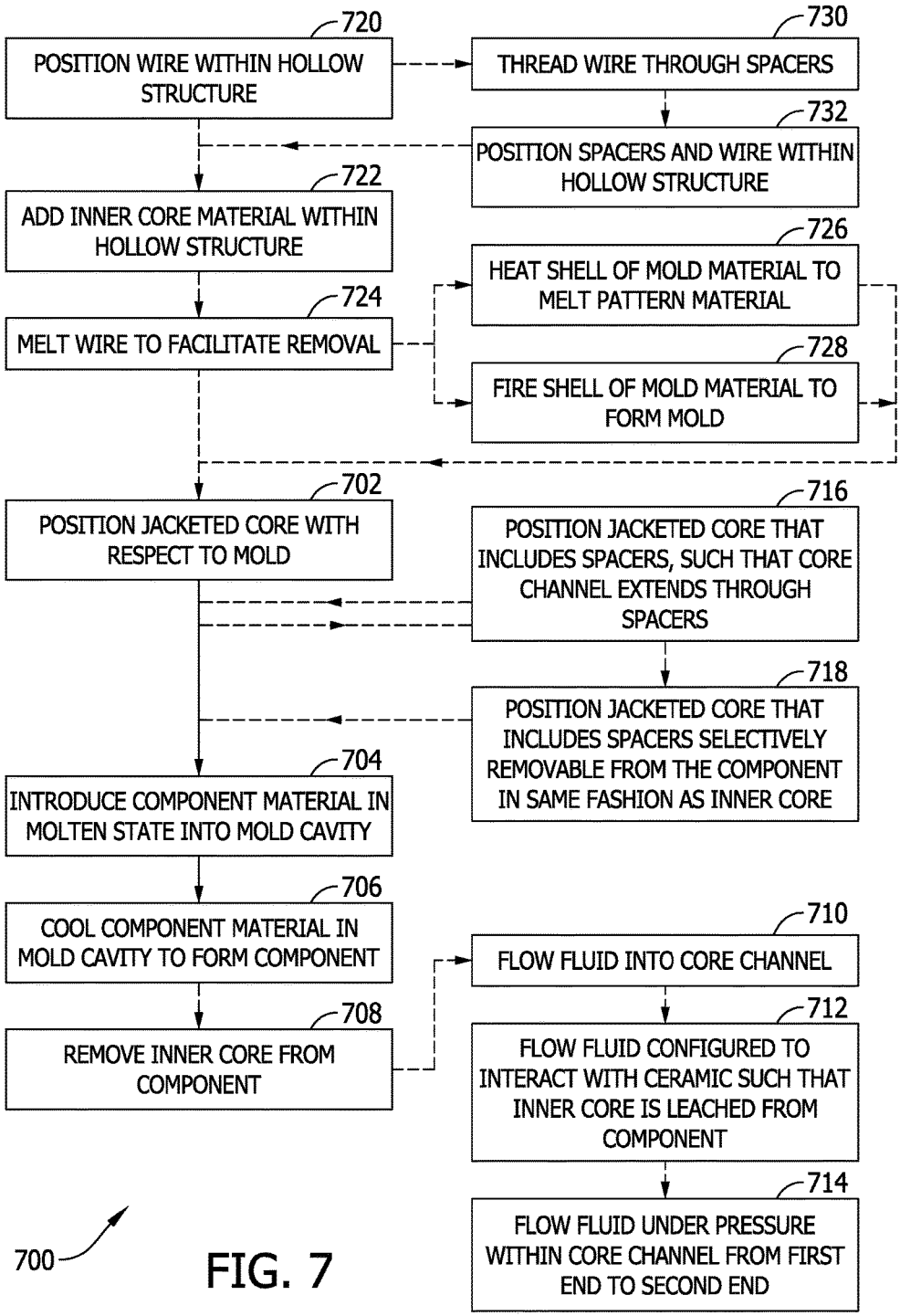
FIG. 7 is a flow diagram of an exemplary method of forming a component having an internal passage defined therein, such as the component shown in FIG. 2.

An exemplary method 700 of forming a component, such as component 80, having an internal passage defined therein, such as internal passage 82, is illustrated in a flow diagram in FIG. 7. With reference also to FIGS. 1-6, exemplary method 700 includes positioning 702 a jacketed core, such as jacketed core 310, with respect to a mold, such as mold 300. The jacketed core includes a hollow structure, such as hollow structure 320, formed from a first material, such as first material 322. The jacketed core also includes an inner core, such as inner core 324 disposed within the hollow structure, and a core channel, such as core channel 360, that extends from at least a first end of the inner core, such as first end 311, through at least a portion of inner core.

Method 700 also includes introducing 704 a component material, such as component material 78, in a molten state into a cavity of the mold, such as mold cavity 304, such that the component material in the molten state at least partially absorbs the first material from the jacketed core within the cavity. Method 700 further includes cooling 706 the component material in the cavity to form the component. The inner core defines a position of the internal passage within the component.

In certain embodiments, method 700 also includes removing 708 the inner core from the component to form the internal passage. In some such embodiments, the step of removing 708 the inner core includes flowing 710 a fluid, such as fluid 362, into the core channel. Moreover, in some such embodiments, the inner core is formed from a ceramic material, and the step of flowing 710 the fluid into the core channel includes flowing 712 the fluid configured to interact with the ceramic material such that the inner core is leached from the component through contact with the fluid. Additionally or alternatively, in some such embodiments, the core channel extends from the first end to an opposite second end of the inner core, such as second end 313, and the step of flowing 710 the fluid into the core channel includes flowing 714 the fluid under pressure within the core channel from the first end to the second end.

In some embodiments, the step of positioning 702 the jacketed core comprises positioning 716 the jacketed core that further includes a plurality of spacers, such as spacers 350, positioned within the hollow structure, such that the core channel extends through each of the spacers. In some such embodiments, the step of positioning 702 the jacketed core includes positioning 718 the jacketed core that further includes the plurality of spacers formed from a material, such as spacer material 352, that is selectively removable from the component along with, and in the same fashion as, the inner core.

In certain embodiments, method 700 further includes forming the jacketed core by positioning 720 a wire, such as wire 340, within the hollow structure, and adding 722 an inner core material, such as inner core material 326, within the hollow structure after the wire is positioned, such that the inner core material fills in around the wire. The wire is formed from a second material, such as second material 342. The inner core material forms the inner core, and the wire defines the core channel within the inner core. In some such embodiments, method 700 additionally includes melting 724 the wire to facilitate removing the wire from the core channel. Moreover, in some such embodiments, the step of melting 724 the wire includes heating 726 a shell of mold material, such as mold material 306, to melt a pattern material positioned within the shell. The jacketed core extends within the pattern material such that the wire is heated above a melting point of the second material. Alternatively, in other such embodiments, the step of melting 724 the wire includes firing 728 a shell of mold material to form the mold. The jacketed core extends within the shell such that the wire is heated above a melting point of the second material.

Additionally or alternatively, in some such embodiments, the step of positioning 720 the wire within the hollow structure includes threading 730 the wire through a plurality of spacers, such as spacers 350, and positioning 732 the spacers threaded with the wire within the hollow structure.

The above-described jacketed core provides a cost-effective method for structurally reinforcing the core used to form components having internal passages defined therein, especially but not limited to internal passages having nonlinear and/or complex shapes, thus reducing or eliminating fragility problems associated with the core. Specifically, the jacketed core includes the inner core, which is positioned within the mold cavity to define the position of the internal passage within the component, and also includes the hollow structure within which the inner core is disposed. The hollow structure provides structural reinforcement to the inner core, enabling the reliable handling and use of cores that are, for example, but without limitation, longer, heavier, thinner, and/or more complex than conventional cores for forming components having an internal passage defined therein. Also, specifically, the hollow structure is formed from a material that is at least partially absorbable by the molten component material introduced into the mold cavity to form the component. Thus, the use of the hollow structure does not interfere with the structural or performance characteristics of the component, and does not interfere with the later removal of the inner core material from the component to form the internal passage. Moreover, the jacketed core is formed with a core channel that extends from at least a first end of the inner core through at least a portion the inner core. The core channel facilitates removal of the inner core from the component to form the internal passage by, for example, enabling application of a leaching fluid to a relatively large area of the inner core along a length of the inner core. In certain embodiments, the jacketed core is initially formed with a wire embedded in the inner core, and the wire defines the core channel. In some such embodiments, the wire is made from a material with a relatively low melting point to facilitate removal of the wire from the jacketed core prior to forming the component.

An exemplary technical effect of the methods, systems, and apparatus described herein includes at least one of: (a) reducing or eliminating fragility problems associated with forming, handling, transport, and/or storage of the core used in forming a component having an internal passage defined therein; (b) enabling the use of longer, heavier, thinner, and/or more complex cores as compared to conventional cores for forming internal passages for components; and (c) reducing or eliminating problems associated with removing the core from the component after the component is formed, especially, but not only for, for cores having large L/d ratios and/or a high degree of nonlinearity.

Exemplary embodiments of jacketed cores are described above in detail. The jacketed cores, and methods and systems using such jacketed cores, are not limited to the specific embodiments described herein, but rather, components of systems and/or steps of the methods may be utilized independently and separately from other components and/or steps described herein. For example, the exemplary embodiments can be implemented and utilized in connection with many other applications that are currently configured to use cores within mold assemblies.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of forming a component having an internal passage defined therein, said method comprising:

positioning a jacketed core with respect to a mold, wherein the jacketed core includes:

a hollow structure formed from a first material;

an inner core disposed within the hollow structure;

a core channel that extends from at least a first end of the inner core through at least a portion of said inner core; and a plurality of spacers positioned within the hollow structure and substantially encased within the inner core, each of the plurality of spacers being positioned at a respective offset distance from an inner surface of the hollow structure such that the core channel extends through each of the spacers;

introducing a component material in a molten state into a cavity of the mold, such that the component material in the molten state at least partially absorbs the first material from the jacketed core within the cavity; and cooling the component material in the cavity to form the component, wherein the inner core defines the internal passage within the component.

2. The method of claim 1 further comprising removing the inner core from the component to form the internal passage.

3. The method of claim 2, wherein removing the inner core comprises flowing a fluid into the core channel.

4. The method of claim 3, wherein the inner core is formed from a ceramic material, and wherein flowing the fluid into the core channel comprises flowing the fluid configured to interact with the ceramic material such that the inner core is leached from the component through contact with the fluid.

5. The method of claim 4, wherein the core channel extends from the first end to an opposite second end of the inner core, and flowing the fluid into the core channel comprises flowing the fluid under pressure within the core channel from the first end to the second end.

6. The method of claim 1, wherein positioning the jacketed core comprises positioning the jacketed core that further includes the plurality of spacers formed from a material that is selectively removable from the component along with, and in the same fashion as, the inner core.

7. The method of claim 1 further comprising forming the jacketed core by:

positioning a wire within the hollow structure, the wire formed from a second material; and adding an inner core material within the hollow structure after the wire is positioned, such that the inner core material fills in around the wire, wherein the inner core material forms the inner core and the wire defines the core channel within the inner core.

8. The method of claim 7 further comprising melting the wire to facilitate removing the wire from the core channel.

9. The method of claim 8, wherein melting the wire comprises heating a shell of mold material to melt a pattern material positioned within the shell, wherein the jacketed core extends within the pattern material such that the wire is heated above a melting point of the second material.

10. The method of claim 8, wherein melting the wire comprises firing a shell of mold material to form the mold, wherein the jacketed core extends within the shell such that the wire is heated above a melting point of the second material.

11. The method of claim 7, wherein positioning the wire within the hollow structure comprises:

threading the wire through the plurality of spacers; and positioning the spacers threaded with the wire within the hollow structure.

12. A mold assembly for use in forming a component having an internal passage defined therein, the component formed from a component material, said mold assembly comprising:

a mold defining a mold cavity therein; and a jacketed core positioned with respect to said mold, said jacketed core comprising:

a hollow structure formed from a first material;

an inner core disposed within said hollow structure;

a core channel that extends from at least a first end of said inner core through at least a portion of said inner core; and a plurality of spacers positioned within said hollow structure and substantially encased within said inner core, each of said plurality of spacers being positioned at a respective offset distance from an inner surface of said hollow structure such that said core channel extends through each of said spacers, wherein:

said first material is at least partially absorbable by the component material in a molten state, and a portion of said jacketed core is positioned within said mold cavity such that said inner core of said portion of said jacketed core defines a position of the internal passage within the component.

13. The mold assembly of claim 12, wherein said inner core is formed from an inner core material that is removable from the component by a fluid flowed into said core channel.

14. The mold assembly of claim 13, wherein said inner core material is a ceramic material that is leachable from the component by the fluid.

15. The mold assembly of claim 12, wherein said core channel extends from said first end to an opposite second end of said inner core.

16. The mold assembly of claim 12, wherein each of said spacers is formed from a material that is selectively removable from the component along with, and in the same fashion as, said inner core.

17. A mold assembly for use in forming a component having an internal passage defined therein, the component formed from a component material, said mold assembly comprising:

a mold defining a mold cavity therein; and a jacketed core positioned with respect to said mold, said jacketed core comprising:

a hollow structure formed from a first material;

an inner core disposed within said hollow structure;

a core channel that extends from at least a first end of said inner core through at least a portion of said inner core; and at least three spacers positioned within said hollow structure and substantially encased within said inner core, such that said core channel extends through each of said spacers, wherein:

said first material is at least partially absorbable by the component material in a molten state, a portion of said jacketed core is positioned within said mold cavity such that said inner core of said portion of said jacketed core defines a position of the internal passage within the component.

18. The mold assembly of claim 17, wherein said inner core is formed from an inner core material that is removable from the component by a fluid flowed into said core channel.

19. The mold assembly of claim 17, wherein said core channel extends from said first end to an opposite second end of said inner core.

20. The mold assembly of claim 17, wherein each of said spacers is formed from a material that is selectively removable from the component along with, and in the same fashion as, said inner core.

* * * * *